United States Patent [19]

Makino et al.

[11] Patent Number: 5,012,737

[45] Date of Patent: May 7, 1991

[54] INK FEEDER WITH MOISTURE REMOVAL

[75] Inventors: Katsuaki Makino; Toshihiro Toyofuku, both of Hiroshima, Japan

[73] Assignee: Mitsubishi Jukogyo Kabushiki Kaisha, Tokyo, Japan

[21] Appl. No.: 397,793

[22] Filed: Aug. 24, 1989

[30] Foreign Application Priority Data

Sep. 22, 1988 [JP] Japan ..... 63-236517

[51] Int. Cl.[5] ..... B41F 31/04; B41F 31/20; B41F 35/00; B41F 7/24

[52] U.S. Cl. ..... 101/350; 101/148

[58] Field of Search ..... 101/148, 350, 349, 363, 101/147, 425, 207, 208-210, 423

[56] References Cited

U.S. PATENT DOCUMENTS

| | | | |
|---|---|---|---|
| 4,387,638 | 6/1983 | Mueller | 101/148 |
| 4,753,165 | 6/1988 | Grosshauser | 101/148 |
| 4,787,314 | 11/1988 | Harada et al. | 101/148 |

FOREIGN PATENT DOCUMENTS

| | | |
|---|---|---|
| 1176674 | 8/1964 | Fed. Rep. of Germany . |
| 2619387 | 12/1981 | Fed. Rep. of Germany . |
| 3326916 | 7/1985 | Fed. Rep. of Germany . |
| 624046 | 7/1981 | Switzerland . |

*Primary Examiner*—J. Reed Fisher

*Attorney, Agent, or Firm*—Wenderoth, Lind & Ponack

[57] ABSTRACT

A known ink feeder in a printing press, including an ink recovery and circulation system for scraping surplus ink from a roller in a printing unit to return it to an ink reservoir, is improved so as to avoid variations in a moisture content in circulating printing ink caused by an accumulation of wetting water in the ink. The improvements reside in that moisture in the surplus ink is positively separated and removed in the ink circulation system by providing a moisture removing device having a rotary roll containing a heater therein and small diameter rolls held in contact with the outer circumference of the rotary roll.

3 Claims, 2 Drawing Sheets

INK FEEDER WITH MOISTURE REMOVAL

BACKGROUND OF THE INVENTION

1. Field of the Invention

The present invention relates to an ink feeder in a keyless printing press or other printing presses. A keyless printing press refers to a printing press in which ink keys in a doctor of an ink source roller are omitted.

2. Description of the Prior Art

One example of a printing unit and an ink feed system in a printing press in the prior art is illustrated in FIG. 3. This printing press includes an ink feed system in which ink i within an ink feed tank 10 is sent under pressure to an ink feed nozzle 13 through piping 11 by means of an ink pump 12 and is fed to an ink source roller 1 by the ink feed nozzle 13. The press further includes a printing unit in which the aforementioned ink i is transferred to a blanket drum 6 via the ink source roller 1, a transfer roller 2, a doctor roller 3, an ink application roller 4 and a plate drum 5 which are rotating in the directions indicated by arrows, whereby printing is effected on a sheet p. Also, there is provided a wetting water device in which wetting water w within a wetting water tank 15 is transferred to the plate drum 5 via a water source roller 16, a brush roller 17, a water reciprocating roller 18 and a water application roller 19. And, furthermore, there is provided an ink recovery system in which surplus ink is scraped by means of a blade 14 disposed against the doctor roller 3 so as to be circulated to an ink feed tank 10.

The above-mentioned blade 14 entirely scrapes surplus ink containing wetting water from the doctor roller 3 to circulate the ink to the ink feed tank 10 where it is recovered. Hence, the wetting water w fed from the wetting water device is partly fed to the sheet p jointly with ink, partly evaporates into the atmosphere, and is partly scraped by the blade 14 under an emulsified condition. The ink is returned to the ink feed tank 10.

In the above-described ink circulation system provided with an ink recovery system, however, since moisture is not contained originally in the ink, the moisture content in the ink rises gradually, and eventually the moisture content of the ink is stabilized due to the feeding of wetting water to the sheet and the evaporation of the wetting water. In the present state of the art, a phenomenon arises in which wetting water made to adhere to a pattern portion is separated therefrom by ink made to adhere to the pattern portion due to a shearing force between the rollers, wherein the wetting water forms drops which fall into the ink feed tank 10. These water drops are observed on the ink surface within the tank in the form of a water pool. And, even in the piping 11 for feeding ink to the ink feed nozzle 13 by means of the ink pump 12, reemulsification would not occur, but water would flow in the portion of the same nozzle 13 back toward the tank. Consequently, water is not fed to the ink source roller 1 but falls again into the ink feed pump 12, and due to repeated circulation of the water, the moisture content in the ink being fed varies gradually. In some cases, there is a possibility of a deterioration in the quality of the printed surface caused by variations in the transfer of the ink.

Furthermore, in the case of color printing in blue, red and/or yellow, since the influence of the moisture content of ink on the printing quality is large in distinction from the case of black and white printing, it is necessary to regulate the moisture content to a low value.

SUMMARY OF THE INVENTION

The present invention has been developed in order to deal with the above-mentioned problems in the prior art, and it is one object of the present invention to provide an improved ink feeder in a printing press in which a moisture content of surplus printing ink scraped from a roller in a printing unit and circulated to an ink feed tank is greatly lowered to improve an ink feed performance and reliability, whereby the quality of printing in enhanced.

According to one feature of the present invention, there is provided an ink feeder including an ink recovery system for scraping ink from a roller in a printing unit to circulate it to an ink feed tank in an ink feed system, and a moisture removing device for receiving the surplus ink and separating and removing moisture from such ink. The moisture removing device comprises a rotary roll containing heater means therein and small-diameter rolls held in contact with the outer circumference of the rotary roll, whereby the surplus ink scraped from a roller is received by the rotary roll containing heater means therein and the small-diameter rolls held in contact with the outer circumference of the rotary roll in the moisture removing device. The moisture in the surplus ink is positively separated and removed, and the moisture content of the feed ink can be greatly reduced.

During operation, the surplus ink containing moisture which has been scraped from a roller in a printing unit, is received by the rotary roll containing heater means therein and small-diameter rolls held in contact with the outer circumference of the same rotary roll. The ink is thus formed into a thin film on the outer circumference of the rotary roll and is heated. Hence, the moisture in the surplus ink is positively evaporated, separated and removed. Thus, the moisture in the recovered ink which is circulated to the ink feed tank in the ink feed system is greatly reduced. Owing to the reduction of the moisture in the feed ink, variations in the transfer of ink in the printing unit are eliminated, and reliability of ink feeding can be realized.

The above-mentioned and other objects, features and advantages of the present invention will become more apparent by referring to the following description of one preferred embodiment of the invention taken in conjunction with the accompanying drawings.

DETAILED DESCRIPTION OF THE PREFERRED EMBODIMENT

Figure 1:
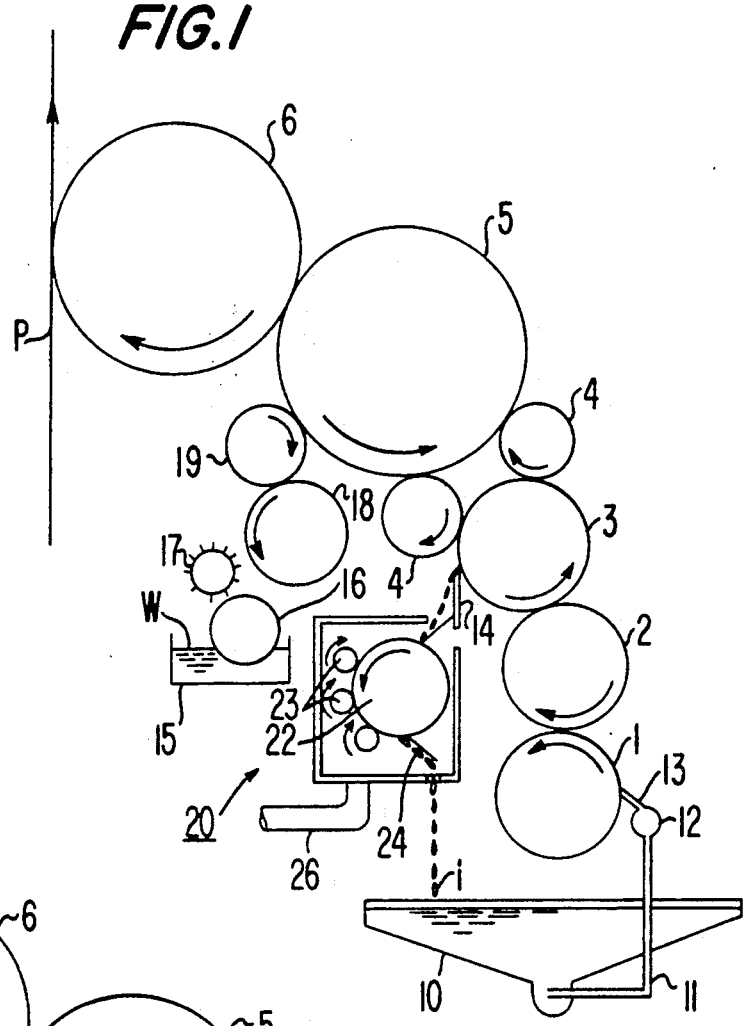
FIG. 1 is a schematic side view of one preferred embodiment of the present invention.
Figure 3:
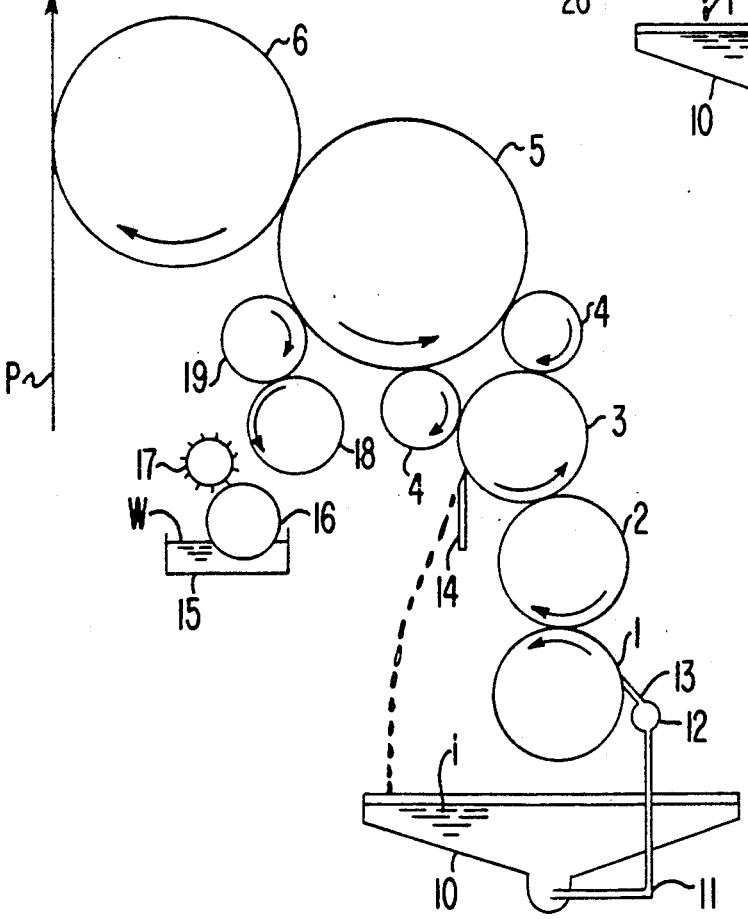
FIG. 3 (PRIOR ART)
FIG. 3 is a schematic side view of an ink feeder in a printing press in the prior art.
Figure 2:
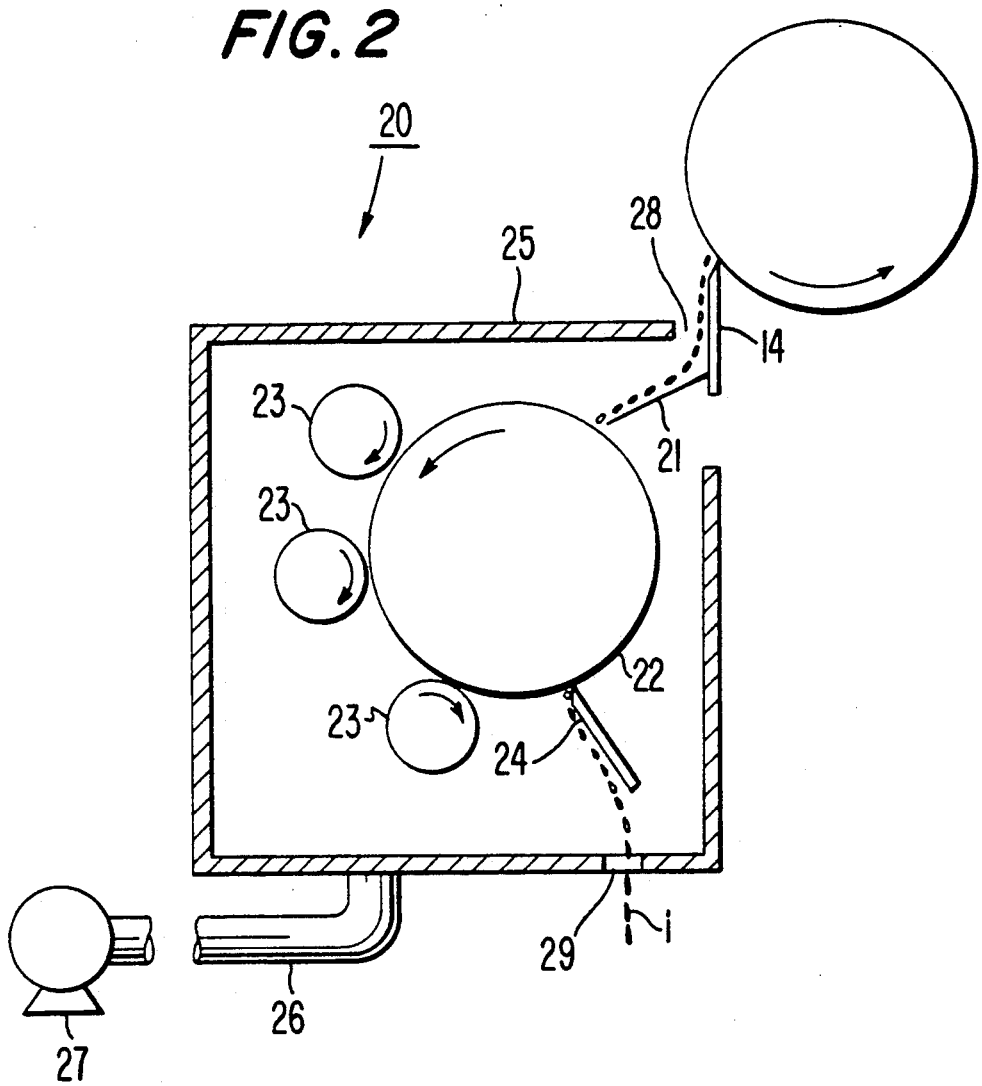
FIG. 2 is an enlarged vertical cross-sectional view of a moisture removing device included in the structure shown in FIG. 1.

One preferred embodiment of the present invention as applied to a printing press is illustrated in FIGS. 1 and 2. The illustrated printing press includes an ink feed system in which ink i within an ink feed tank 10 is sent under pressure to an ink feed nozzle 13 through piping 11 by means of an ink pump 12 and is fed to an ink source roller 1 by the ink feed nozzle 13. The printing press further includes a printing unit, in which the ink i is transferred to a blanket roller 6 via the ink source roller 1, a transfer roller 2, a doctor roller 3, an ink application roller 4 and a plate drum 5 which are rotating in the directions indicated by arrows, and thus printing is effected on a sheet p. Also, there is provided a wetting water device in which wetting water w within a wetting water tank 15 is transferred to the plate drum 5 via a water source roller 16, a brush roller 17, a water reciprocating roller 18 and a water application roller 19. Furthermore, there is provided an ink recovery system in which surplus ink containing wetting water w on the doctor roller 3 is scraped off by means of a blade 14 disposed against the doctor roller 3 so as to be circulated to the ink feed tank 10 in the ink feed system.

Still further, the ink recovery system for scraping surplus ink containing wetting water w from the doctor roll 3 by means of the blade 14 disposed against the doctor roll 3 further includes a moisture removing device 20 which receives the aforementioned surplus ink and separates and removes a moisture component and which comprises a rotary roll 22 containing heater means therein and small-diameter rolls 23 held in contact with the outer circumference of the rotary roll 22.

Describing now the above-mentioned moisture removing device 20 in more detail, as shown in FIGS. 1 and 2, a chamber 25 defines an inlet 28 for receiving the abovedescribed surplus ink scraped from the doctor roll 3 and an outlet 29 for discharging recovered ink i after the removal of moisture therefrom. A rotary roll 22 is rotatably driven in the direction shown by an arrow by any appropriate means (not shown) and a plurality of small-diameter rolls 23 are held in contact with the outer circumference of the rotary roll 22 and rotate in the direction indicated by an arrow. A chute 21 is disposed between the doctor 14 and the rotary roll 22. A doctor 24 for scraping recovered ink i from rotary roll 22 after moisture is removed therefrom is disposed against the outer circumference of the rotary roll 22. The bottom of the chamber 25 is connected to a blower (or an air exhaust machine) 27 via piping 26. And, within the rotary roll 22 is heater means to which a thermal medium such as hot water, steam, oil, etc. is fed.

Now the operation of the illustrated embodiment having the above-described construction will be described. Ink is continuously fed to the ink source roller 1 by the ink feed nozzle 13 in the ink feed system, wetting water w is fed to the plate drum 5 by the wetting device, the ink and the wetting water are conveyed or transferred in the printing unit similarly to the printing press in the prior art, and printing is effected on a sheet p.

In addition, the surplus ink containing the wetting water w on the doctor roller 3 is entirely scraped therefrom by the doctor 14, is introduced into the chamber 25 via the chute 21, and is received on the outer circumference of the rotary roll 22.

Since the rotary roll 22 is rotated at a high speed in the direction indicated by an arrow and the above-described thermal medium is fed to the inside of the rotary roll 22, the above-mentioned surplus ink is received and conveyed on the outer circumference of the rotary roll 22. During conveyance, the surplus ink is formed into a thin film on the above-mentioned outer circumference due to nipping pressures of the respective small-diameter rolls 23. The thin film of ink is heated by heat from the above-described thermal medium within the inside of the roll 22, and hence, the moisture in the surplus ink is positively evaporated, and thereby separated and removed.

The separated and removed moisture in the form of steam is purged to the outside of the chamber 25 by the air fed through the piping 26 by means of the blower 27. Thus, the above-mentioned evaporation is promoted, and recovered ink i having moisture separated and removed therefrom is scraped by the doctor 24, and is passed through the outlet 29 to be circulated to and recovered by the ink feed tank 10 in the ink feed system.

The temperature and flow rate of the thermal medium within the rotary roll 22, the flow rate of air exhausting from the chamber 25 caused by the blower 27, the temperature within the chamber 25 and the like are adjustably controlled by appropriate means omitted from the illustrations. And, evaporation of the moisture in the ink is properly adjusted in dependence on the amount of surplus ink scraped by the blade 14.

According to the present invention having the abovedescribed characteristic feature moisture in surplus ink scraped from the surface of a roller in a printing unit and circulated to an ink feed tank in an ink feed system, can be positively separated and removed by a rotary roll containing heater means therein and small-diameter rolls held in contact with the rotary roll in a moisture removing device provided in an ink recovery system. Hence, a moisture content of ink can be greatly lowered, variations in the transfer of ink are eliminated, ink feed performance and reliability are improved, and printing quality can be enhanced.

While the present invention has been described above in connection with one preferred embodiment, it is a matter of course that the present invention should not be limited to only such embodiment. Rather, various changes and modifications can be made without departing from the spirit of the present invention.

What is claimed is:

1. An ink feeder for feeding ink in a printing press, said ink feeder comprising:

a printing unit comprising a roller;

ink feed means for feeding ink to the roller of the printing unit, said ink feed means including an ink feed tank for accommodating a supply of ink; and an ink recovery system comprising scraping means for scraping surplus ink from the roller of said printing unit, and moisture removing means for receiving the surplus ink scraped from said roller by said scraping means, for removing moisture from the surplus ink, and for returning the surplus ink to said ink feed tank once the moisture has been removed therefrom, said moisture removing means including a rotary roll rotatably supported in the ink recovery system at a position to receive surplus ink that has been scraped from the roll of said printing unit by said scraping means, and small-diameter rolls rotatably supported in the ink recovery system and contacting said rotary roll at the outer circumference thereof so as to coact with said rotary roll and form the surplus ink received by said rotary roll into a thin film on the outer circumference of said rotary roll, said rotary roll having heating means therein for heating the surplus ink on the outer circumference thereof to evaporate moisture from the surplus ink.

2. An ink feed system as claimed in claim 1, wherein said moisture removing means further includes a chamber defining an ink outlet, means disposed downstream of said small-diameter rolls with respect to a direction of rotation of said rotary roll for transferring the thin film of surplus ink from said rotary roll to said ink feed tank via said ink outlet, and blower means operatively connected to said chamber for purging said chamber of moisture which has been evaporated from the surplus ink by said heater means.

3. An ink feed system as claimed in claim 1, wherein the roller of said printing unit is a doctor roller, and said scraping means comprises a doctor blade.

* * * * *